United States Patent [19]

Auriemma

[11] 4,279,572

[45] Jul. 21, 1981

[54] SIDEPLATES FOR ROTOR DISK AND ROTOR BLADES

[75] Inventor: Peter R. Auriemma, Palm Beach Gardens, Fla.

[73] Assignee: United Technologies Corporation, Hartford, Conn.

[21] Appl. No.: 55,562

[22] Filed: Jul. 9, 1979

[51] Int. Cl.[3] ..... F01D 5/18; F01D 5/30

[52] U.S. Cl. ..... 416/220 R

[58] Field of Search ..... 416/220 R, 193 A

[56] References Cited

U.S. PATENT DOCUMENTS

| | | | |
|---|---|---|---|
| 3,181,835 | 5/1965 | Davis | 416/220 |
| 3,395,891 | 8/1968 | Burge et al. | 416/220 |
| 3,501,249 | 3/1970 | Scalzo et al. | 416/95 |
| 3,644,058 | 2/1972 | Barnabel | 416/95 |
| 3,728,042 | 4/1973 | Hugoson | 416/95 |
| 3,748,060 | 7/1973 | Hugoson | 416/92 |
| 3,751,183 | 8/1973 | Nichols | 416/220 |
| 3,752,598 | 8/1973 | Bowers | 416/173 |
| 3,841,792 | 10/1974 | Amos | 416/172 |
| 4,021,138 | 5/1977 | Scalzo et al. | 416/220 |
| 4,171,930 | 10/1979 | Brisken et al. | 416/220 |

*Primary Examiner*—William L. Freeh

*Attorney, Agent, or Firm*—Gene D. Fleischhauer

[57] ABSTRACT

A rotor sideplate for inhibiting the leakage of fluid mediums across a blade and disk assembly of a gas turbine engine is disclosed. Techniques for preventing the leakage of working medium gases across the assembly beneath the platforms and for preventing the leakage of turbine cooling air are developed. Various construction details which enhance the fatigue performance of the sideplate are developed. The sideplate is supported from the rotor disk at more than one support point.

11 Claims, 3 Drawing Figures

FIG. 1
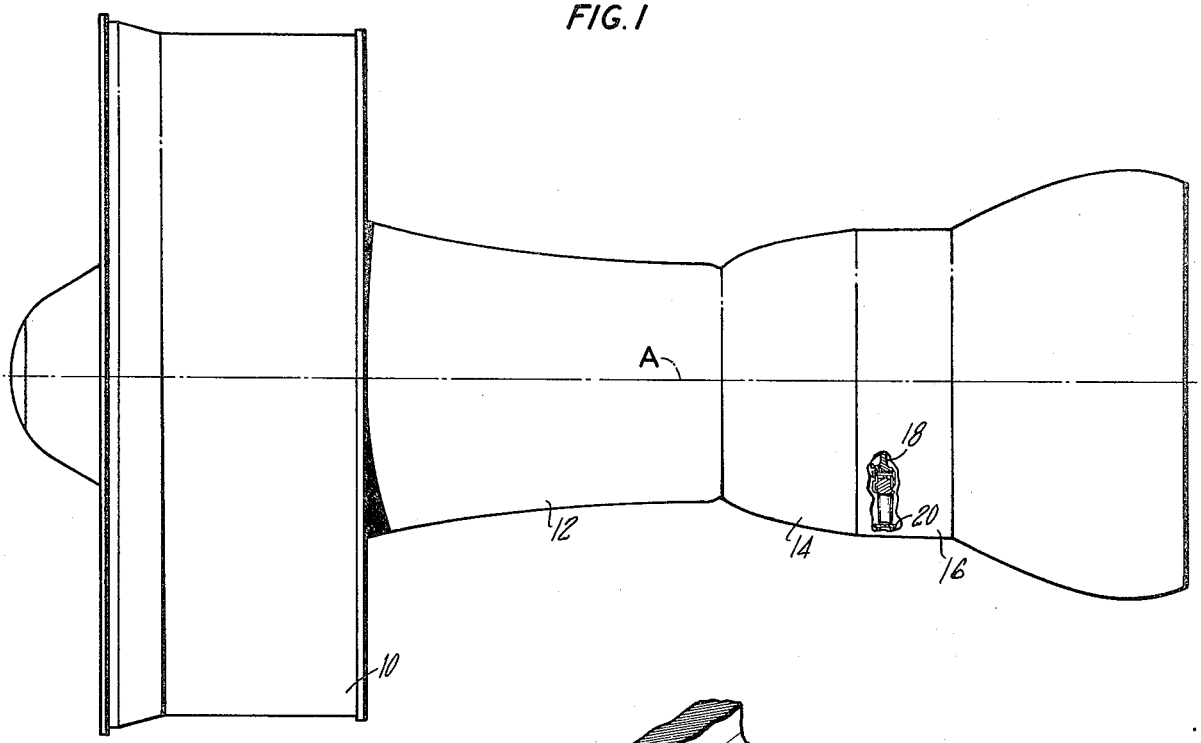
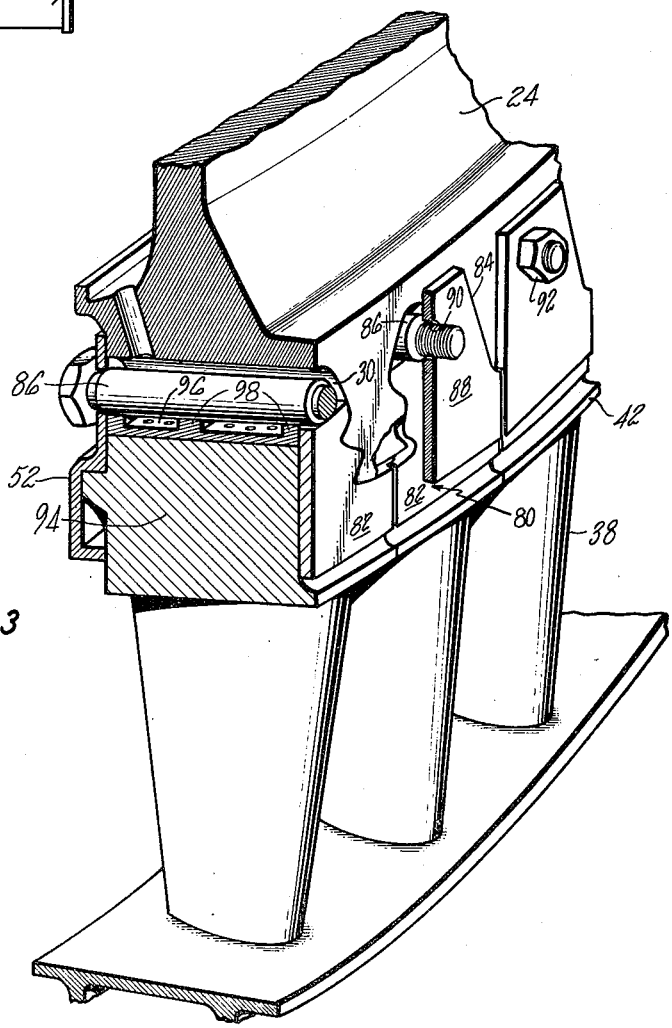
FIG. 3

SIDEPLATES FOR ROTOR DISK AND ROTOR BLADES

BACKGROUND OF THE INVENTION

This invention relates to gas turbine engines and more particularly to a blade and disk assembly having sideplates in such an engine.

A gas turbine engine has a compression section, a combustion section and a turbine section. A rotor assembly extends axially through the turbine section and the compression section. The rotor assembly includes disks and rows of rotor blades extending outwardly from the disk. A stator circumscribes the rotor. An annular flow path for working medium gases extends axially through the turbine section between the stator assembly and the rotor assembly.

Conventionally, each disk is adapted by a plurality of circumferentially spaced slots to receive the rotor blades. These slots extend in a substantially axial direction across the rim of the disk. The rotor blades generally have an airfoil section, a platform section and a root section. The root section of each rotor blade engages a corresponding slot in the disk. The platform sections of adjacent rotor blades generally abut. In many constructions the platforms are radially spaced from the disk. Because the blades are also circumferentially spaced one from another to engage the circumferentially spaced slots, a gap is left between the blades beneath the abutting platforms. A rotor sideplate is attached to the disk to close the gap. This closure blocks the hot working medium gases from flowing under the platform and causes the working medium to follow the prescribed path along the annular flow path. An example of such a structure is shown in U.S. Pat. No. 3,137,478 to Farrell entitled, "Cover Plate Assembly for Sealing Spaces Between Turbine Buckets".

Fuel is burned in the combustion section with the working medium to add energy to the working medium. The temperature of the working medium increases dramatically and may be as high as 2500° F. or greater immediately downstream of the combustion. The hot working medium flows out of the combustion section and into the turbine section. The rotor blades are bathed in the hot medium and, in many constructions, are cooled by cooling air which flows through the interior of the blade. A cooling air cavity between the bottom of the blade root and the disk provides a manifold for the cooling air passing from the disk into the turbine blade. The ends of such a cavity are also sealed by sideplates in these constructions. The sideplates may also provide axial retention of the rotor blade by engaging the disk. An example of such a construction is shown in U.S. Pat. No. 3,728,042 to Hugoson et al. entitled, "Axial Positioner and Seal for Cooled Rotor Blade".

Many constructions use a single sideplate to cover the gap between adjacent blade roots and the ends of the cooling cavity. An example of such a construction is shown in U.S. Pat. No. 3,936,222 to Asplund et al. entitled, "Gas Turbine Construction". Such sideplates are retained axially and radially as a unit. Because the entire rotational load of the sideplate is carried by a shoulder on the disk, the sideplate is thickened to decrease the total stresses near the single point of attachment. This thickness enables a satisfactory fatigue life by keeping the total stress below the fatigue strength. As gas turbine engines are operated at higher and higher speeds, thickening the sideplate does not always result in an acceptable fatigue life. In addition, increasing the thickness adds weight and axially displaces the center of gravity of the sideplate in the downstream direction. Accordingly, increasing the thickness increases the bending stresses which the sideplate exerts on the disk and adversely affects the fatigue life of the disk.

Scientists and engineers are searching for a sideplate which provides axial retention to a rotor blade and blocks the passage of working medium between the roots of adjacent rotor blades while sealing the cooling air cavity between the blade root and the disk. The weight of the sideplate must be low and the total stresses in such a sideplate must be below the fatigue strength of the sideplate.

SUMMARY OF THE INVENTION

A primary object of the present invention is to increase the fatigue performance of a rotor assembly having a sideplate which sealingly extends between a rotor disk, a cooled rotor blade and the platforms of adjacent blades in an axial flow gas turbine engine. Another object is to axially retain the rotor blade. A further object is to support the sideplate against axial and radial loads. An object is to conserve the cooling medium which flows through the cooled rotor blade. Another object is to provide a sideplate having a low weight.

According to the present invention, a rotor assembly has a rotor disk including slots for rotor blades and has a sideplate including a first piece which engages a corresponding slot in the disk and a second piece which engages the disk to provide axial retention to the first piece and to the rotor blade.

A primary feature of the present invention is the rotor sideplate having a first piece and a second piece. The first piece has a circumferentially extending rim section and an inwardly extending root section. The disk has an attachment slot which receives the first piece. The second piece has a cover plate which extends over the disk and over the first piece and has an axially extending shank. Another feature is the root section of the rotor blade which engages the shank of the second piece.

A principal advantage of the present invention is the fatigue performance of the sideplate which results from the use of multiple support points for the sideplate. Another advantage is the conservation of the cooling medium which results from sealing the cavity between the blade root and the disk. Still another advantage is the efficient utilization of the working medium which results from blocking the gap between adjacent blade roots.

The foregoing, and other objects, features and advantages of the present invention will become more apparent in the light of the following detailed description of the preferred embodiment thereof as shown in the accompanying drawing.

BRIEF DESCRIPTION OF THE DRAWINGS

FIG. 1 is a simplified, side elevation view of a turbofan engine with a portion of a turbine section broken away to reveal portions of the rotor and stator assemblies.

FIG. 3 is a cross section corresponding to the FIG. 2 view and shows an alternate embodiment with one rotor blade removed to show a slot.

DESCRIPTION OF THE PREFERRED EMBODIMENT

Figure 2:
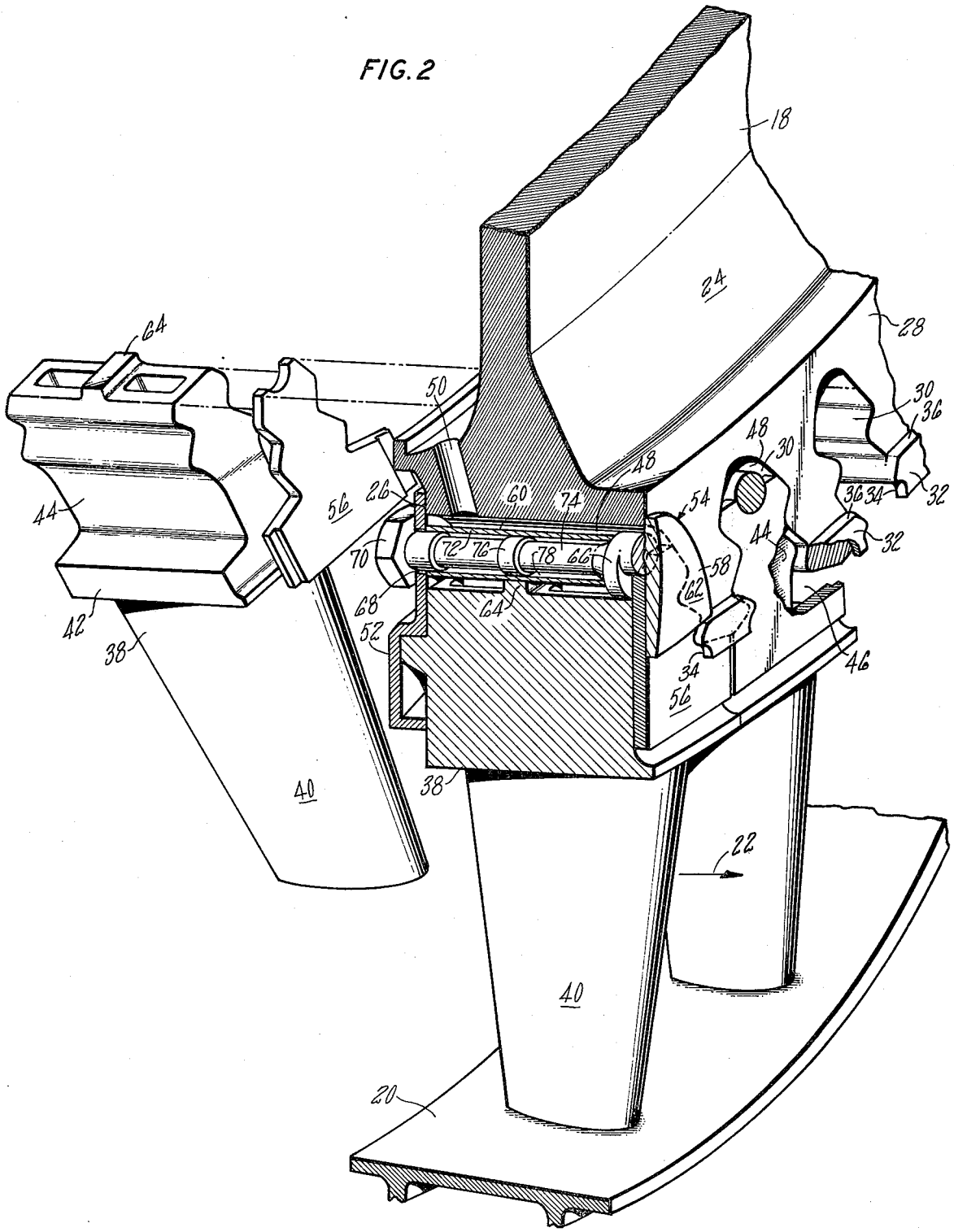
FIG. 2 is an enlarged cross section view of a portion of the rotor and stator assemblies shown in FIG. 1 with a portion of the lug broken away.

A turbofan gas turbine engine embodiment of the invention is illustrated in FIG. 1. The engine has an axis A. Principal sections of the engine include a fan section 10, a compression section 12, a combustion section 14 and a turbine section 16. A rotor assembly 18 extends axially through the principal section. A stator assembly 20 circumscribes the rotor assembly.

FIG. 2 is an enlarged, cross section view showing a portion of the rotor assembly 18 and the stator assembly 20. An annular flow path 22 for working medium gases extends axially through the turbine section between the stator assembly and the rotor assembly. The rotor assembly includes a disk 24 having an axis A. The disk has an upstream face 26, a downstream face 28 and a plurality of circumferentially spaced slots 30 extending therebetween. A lug 32 extends outwardly between each pair of adjacent slots. Each lug has an upstream face 34 which lies in the same plane as the plane of the downstream face of the disk in the region of the slot. Each lug has a shoulder 36 which faces inwardly toward the axis of the disk.

The rotor assembly 18 includes a coolable rotor blade 38 at each slot 30. The rotor blade extends outwardly from the disk across the annular flow path 22. The rotor blade has an airfoil section 40, a platform section 42 and a root section 44. The root section of the rotor blade is circumferentially spaced from the root section of each of the adjacent rotor blades leaving a gap 46 therebetween. The rotor blade engages the outer portion of the slot leaving a cavity 48 at the base of the root section between the blade and the disk. An inlet passage 50 for cooling air is in gas communication with the cavity. An upstream sideplate 52 at each slot engages the upstream face of the disk and the blade to close the upstream end of the cavity. A downstream sideplate 54 at each slot engages the downstream face of the disk and the blade to close the downstream end of the cavity.

The downstream sideplate 54 includes a first piece 56 and a second piece 58. The first piece engages the slot 30 in the disk 24 and extends outwardly into proximity with the platform section 42 of the rotor blade 38 engaging the same slot. The second piece has a shank 60 and a plate 62. The plate overlaps the disk, the first piece, and the interface between the first piece and the disk. The shank extends across the disk through the cavity 48 inwardly of the root section 44. A pedestal 64 extends inwardly from the root section of the rotor blade to engage the shank 60. The shank has a collar 66 extending outwardly to engage the root section. The first piece 56 of the downstream sideplate engages the shank. The upstream sideplate 52 has a hole 68. The shank extends through the hole and engages a means for applying an axial force such as the nut 70. The shank includes a sleeve 72 and a shaft 74. The shaft has a central portion 76 having a diameter smaller than the sleeve. The shaft is spaced from the surrounding sleeve to form an annular cavity 78.

FIG. 3 shows an alternate embodiment of the invention having another configuration for supporting a downstream sideplate 80. The downstream sideplate includes a first piece 82 and a second piece 84. The second piece has a shank 86 and a plate 88. The plate has a hole 90. The shank extends axially through the hole in the plate. A means for applying an axial force, such as the nut 92, engages the shank. The blade root 94 includes a metering plate 96 having two pedestals 98 which extend inwardly to engage the shank. The second piece of the rotor sideplate extends outwardly beyond the outermost extension of the disk into proximity with the platform section 42 of the rotor blade 38 engaging the same slot. The second piece is attached, for example by bonding, to the first piece.

During operation of the gas turbine engine, air is compressed by the fan section 10, and the compressor section 12. The air flows out of the compressor section into the combustion section 14. In the combustion section, fuel is burned with the working medium to add energy to the medium and causes a dramatic increase in the temperature of the medium. As the hot, high pressure, medium leaves the combustion section, the medium flows along the annular flow path 22 through the turbine section, and bathes the rotor blades in the hot medium. The first piece 56 of each rotor sideplate cooperates with the adjacent first piece to close the gap 46 between the root sections 44 of the adjacent rotor blades 38. This closure blocks the hot working medium gases from flowing under the adjacent platform sections 42.

The blades are cooled to prevent deterioration of the material from which the blades are formed. Cooling air is flowed into each rotor blade through the inlet passage 50 and the cavity 48. The ends of the cavity are closed by the upstream sideplate 52 and the downstream sideplate 54. The cooling air passes through the airfoil section and is subsequently discharged into the hot working medium.

As the hot working medium at high pressure passes through the airfoil section 40, energy is imparted to the rotor assembly 18 causing the assembly to rotate at speeds as high as 13,000 revolutions per minute. This high speed of rotation causes mechanical stresses in the rotor sideplate. The total stress, which is the sum of the mechanical and thermal stresses, must be below the fatigue strength of the components or fatigue failure of the components will take place. Such a destructive failure causes considerable damage to the downstream rotor blades and other engine components.

A distinct and particular advantage of this invention is the avoidance of high mechanical stresses near the support points in the downstream sideplate. Avoiding the high stresses avoids the need for a thickened sideplate near the point of attachment and enables a sideplate design which is low in weight. The design avoids the high stresses near any one support point by resisting the rotational forces exerted by the sideplate components at several support points. Consider the second piece 58 of the downstream sideplate 54. The rotational forces associated with the shank 60 are transmitted to the disk 24 through the root section 44 of the blade by the collar 66 on the shank, the pedestal 64 on the root section, and the upstream sideplate 52; and, through the first piece 56 of the downstream sideplate by contact between the shank and the first piece. The first piece transfers its own load to the disk through the sides of the slot 30. The slot has a complex attachment shape to reduce the resulting stresses. The plate 62 adjusts outwardly in response to the operational forces to engage the shoulders 36 on the adjacent lugs 32 to transmit the rotational load of the plate directly to the disk.

The working medium exerts axial forces on the rotor blades 38 causing each rotor blade to adjust rearwardly. As the root section 44 of the rotor blade adjusts rearwardly, the root engages the downstream sideplate 54.

The root section 44 urges the first piece 56 of the sideplate rearwardly to engage the plate 62 of the second piece and the upstream face 34 of the lug 32. Axial retention of the rotor blade results from this engagement between the root section and the downstream sideplate 54. The plate 62 transmits a portion of the axial forces to the disk through the shank 60 and the upstream sideplate 52.

During decelerations of the gas turbine engine, the temperature of the cooling air drops. The temperature of the working medium also drops. The air in the cavity 48 cools the sleeve 72 and the shaft 74 of the shank 60. The thermal capacitance or thermal capacity (Mass×-Specific Heat) of the disk is much greater than the thermal capacitance of the shaft. Articles having a low thermal capacitance react much faster to changes in temperature than do items having a high thermal capacitance. The sleeve circumscribes the shaft to shield the shaft from the cooling air and avoids the high stresses which would result from the bolt contracting faster than the axial length of the disk.

The alternate embodiment in FIG. 3 shows a construction enabling the downstream sideplate 80 to transmit rotational forces to the disk 24 through the slot 30 and to transmit axial forces to the disk through the upstream sideplate 52. Axial forces acting on the blade are transmitted to the disk through the downstream sideplate 82, the shank 86 and the upstream sideplate 52. The shank 86 transmits rotational forces to the disk 24 through the root section 94 and the sides of the slot by engaging the pedestals 98 on the metering plate 96. Rotational forces acting on the second piece 84, which is bonded to the first piece, and on the first piece 82 are transmitted to the sides of the slot in the disk through the first piece 82.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. For a gas turbine engine having an axially extending flow path with an upstream end and a downstream end, a rotor assembly including:

a disk having an upstream face, a downstream face, and a plurality of circumferentially spaced slots extending therebetween;

a rotor blade at each slot, each blade having a platform section and a root section, wherein the root section engages the outer portion of the slot in the disk leaving a cavity at the base of said root section between the blade and the disk;

a rotor sideplate at each slot wherein each sideplate comprises a first piece which engages the slot in the disk and extends outwardly into proximity with the platform section of the blade engaging the same slot;

a second piece having a shank extending across the disk through the cavity inwardly of the root section of the blade;

a plate at one end of the shank which extends across one end of the cavity and across the interface between the disk and the first piece;

a means for urging the plate against the downstream face of the disk;

wherein the first piece is trapped in the slot by the plate of the second piece and the plate of the second piece closes the cavity between the blade and the disk;

a means at each slot engaging the slot in the disk for restraining the rotor sideplate against rotational forces.

2. The invention according to claim 1 wherein the means for restraining the rotor sideplate against rotational forces includes a collar on the shank of the sideplate which engages the root section of the blade and a pedestal extending inwardly from the root section of the rotor blade which engages the shank of the sideplate.

3. The invention according to claim 1 wherein the means for restraining the rotor sideplate against rotational forces includes the first piece of the sideplate which engages the blade attachment slot of the disk and which engages the shank of the second piece.

4. The invention according to claim 1 wherein the means for restraining the rotor sideplate rotational forces includes the first piece of the sideplate which engages the blade attachment slot of the disk and which is attached to the second piece of the sideplate.

5. The invention according to claim 4 wherein the plate of the second piece is attached by bonding to the first piece.

6. For a gas turbine engine having an axially extending flow path with an upstream end and a downstream end, a rotor assembly including:

a disk having an upstream face, a downstream face, and a plurality of circumferentially spaced slots extending therebetween;

a rotor blade at each slot, each blade having a platform section and a root section, wherein the root section engages the outer portion of the slot in the disk leaving a cavity at the base of said root section between the blade and the disk;

a rotor sideplate at each slot wherein each sideplate comprises a first piece which engages the slot in the disk and extends outwardly into proximity with the platform section of the blade engaging the same slot;

a second piece having a shank extending across the disk through the cavity inwardly of the root section of the blade;

a plate at one end of the shank which extends across one end of the cavity and across the interface between the disk and the first piece;

a means for urging the plate against the downstream face of the disk;

wherein the first piece is trapped in the slot by the plate of the second piece, the plate of the second piece closes the cavity between the blade and the disk, and the shank of the second piece engages the root section of said blade.

7. The invention according to claim 1 or claim 6 wherein the first piece engages the shank of the second piece.

8. The invention according to claim 6 wherein the disk further has a lug extending outwardly from the disk between each pair of adjacent slots having an upstream face which lies in the plane of the downstream face of the disk a shoulder which faces inwardly toward the axis of the disk, wherein the first piece is trapped in said slot by the adjacent lugs and by the plate of the second piece and the plate is free to move outwardly into abutting relationship with the shoulder of each of said pair of adjacent disk lugs in operative response to rotational forces.

9. The invention according to claim 6 wherein said blade root has at least one pedestal extending inwardly from the root and the shank of the second piece engages at least one pedestal.

10. The invention according to claim 9 wherein said shank has a collar engaging the blade root.

11. For a gas turbine engine having an axially extending flow path with an upstream end and a downstream end, a rotor assembly including:

a disk having an upstream face, a downstream face, a plurality of circumferentially spaced slots extending therebetween and a lug extending between each pair of adjacent slots which extends outwardly from the disk, each lug having an upstream face which lies in the plane of the downstream face of the disk, a shoulder which faces inwardly toward the axis of the disk;

a rotor blade at each slot, each blade having a platform section and a root section, wherein the root section engages the outer portion of the slot in the disk leaving a capacity at the base of said root section between the blade and the disk, and each blade having a pedestal extending inwardly from the root section of the blade;

a rotor sideplate at each slot each comprising a first piece engaging the slot in the disk, and extending outwardly into proximity with the platform section of the blade engaging the same slot, and a second piece having a shank having a collar and extending across the disk through the cavity inwardly of the root section of the blade, and a plate at one end of the shank, which extends across one end of the cavity and across the interface between the disk and said blade;

a means for urging each plate against the downstream face of the disk which engages the upstream face of the disk and a corresponding shank of the second piece wherein the first piece is trapped in the slot by the adjacent lugs and by the plate of the second piece, and wherein the second piece is radially trapped by the first piece which engages the shank of the second piece, by the blade which engages the shank through the pedestal on the blade and through the collar on the shank, and by the shoulder of each of the adjacent lugs each shoulder engaging the plate of the second piece, the plate being free to move outwardly into abutting relationship with each shoulder in operative response to rotational forces.

* * * * *

UNITED STATES PATENT AND TRADEMARK OFFICE

CERTIFICATE OF CORRECTION

PATENT NO. : 4,279,572

DATED : July 21, 1981

INVENTOR(S) : Peter R. Auriemma

It is certified that error appears in the above—identified patent and that said Letters Patent is hereby corrected as shown below:

Col. 6, claim 4, line 22 after "sideplate" insert -- against --

Col. 6, claim 5, line 26 after "claim 4" insert -- or claim 6 --

Col. 7, claim 11, line 29 "capacity" should be -- cavity --

Signed and Sealed this

*Fifteenth* Day of *December 1981*

[SEAL]

*Attest:*

GERALD J. MOSSINGHOFF

*Attesting Officer* *Commissioner of Patents and Trademarks*